US005601467A

United States Patent [19]

Carroll

[11] Patent Number: 5,601,467

[45] Date of Patent: Feb. 11, 1997

[54] METHOD FOR MANUFACTURING A LOW RESISTANT ELECTROLUMINESCENT DISPLAY DEVICE

[75] Inventor: Roger Carroll, Willimantic, Conn.

[73] Assignee: Northrop Grumman Corporation, Los Angeles, Calif.

[21] Appl. No.: 491,651

[22] Filed: Jun. 19, 1995

[51] Int. Cl.[6] ..... H01J 9/227

[52] U.S. Cl. ..... 445/24; 445/58; 427/68

[58] Field of Search ..... 313/505, 509, 313/506, 512; 427/66, 68; 445/24, 58

[56] References Cited

U.S. PATENT DOCUMENTS

| | | | |
|---|---|---|---|
| 4,728,519 | 3/1988 | Tanimoto | 427/66 |
| 5,302,468 | 4/1994 | Namiki et al. | 313/505 X |
| 5,517,080 | 5/1996 | Budzilek et al. | 313/509 |

FOREIGN PATENT DOCUMENTS

WO93/26139 12/1993 WIPO .

OTHER PUBLICATIONS

O. J. Gregory et al., "Fabrication of High Conductivity Transport Electrodes with Trenched Metal Bus Lines," *Journal of the Electro Chemical Society*, vol. 138, No. 7, Jul. 1991.

*Primary Examiner*—Kenneth J. Ramsey

[57] ABSTRACT

An improved electroluminescent display of the type having a substrate on which are applied ITO electrodes having dielectric, phosphor and dielectric stacks positioned thereon is formed with cavities between the stacks which expose a portion of each ITO electrode. The structure is annealed before or after the cavities are cut. Then a metal assist structure applied over the exposed portion of each ITO electrode. A planarization layer is applied over each metal assist structure and metal electrodes are placed to complete the display.

6 Claims, 3 Drawing Sheets

METHOD FOR MANUFACTURING A LOW RESISTANT ELECTROLUMINESCENT DISPLAY DEVICE

TECHNICAL FIELD

This invention relates to electroluminescent display panels.

BACKGROUND OF THE ART

Thin film electroluminescent (TFEL) display panels offer several advantages over other display technologies such as cathode ray tubes and liquid crystal displays. Compared with cathode ray tubes, TFEL display panels require less power, provide a larger viewing angle, and are much thinner. Compared with liquid crystal displays, TFEL display panels have a larger viewing angle, do not require auxiliary lighting and can have a larger display area.

FIG. 1 shows a prior art TFEL display panel. The TFEL display has a glass panel 10, a plurality of transparent electrodes 12, a first layer of dielectric 14, a phosphor layer 16, a second dielectric layer 18, and a plurality of metal electrodes 20 perpendicular to the transparent electrodes 12. The transparent electrodes 12 are typically indium-tin oxide (ITO) and the metal electrodes 20 are typically aluminum. The dielectric layers 14, 18 protect the phosphor layer 16 from excessive dc currents. When an electrical potential, such as about 200 V, is applied between the transparent electrodes 12 and the metal electrodes 20, electrons tunnel from one of the interfaces between the dielectric layers 14, 18 and the phosphor layer 16 into the phosphor layer where they are rapidly accelerated. The phosphor layer 16 typically comprises ZnS doped with Mn. Electrons entering the phosphor layer 16 excite the Mn causing the Mn to emit photons. The photons pass through the first dielectric layer 14, the transparent electrodes 12, and the glass panel 10 to form a visible image.

Speed and brightness uniformity of the electroluminescent display depend critically on the ITO line resistance, particularly for large area displays. Even with integrated ITO lines, a zebra pattern brightness contrast occurs due to high resistance. Therefore, to achieve higher conductivity of the transparent electrodes in the electroluminescent display panel, structures have been developed in which the low conductivity ITO electrodes were augmented by buses of thick, narrow, high conductivity metals. In the most common augmented ITO panel the metal assist structure is on top of the ITO electrode and adjacent the overlaying dielectric layer.

During the manufacture of TFEL displays it is necessary to anneal the structure after applying the stack of a dielectric layer, phosphor layer and dielectric layer over the transparent electrodes and metal substrate. In those displays which have metal assist structures between the ITO electrode and the dielectric layer, migration occurs between the metal assist structure and the dielectric layer. Such migration is generally considered undesirable because this migration can result in increased resistance of the metal assist structure.

O. J. Gregory et al. discuss the migration problem in their article "Fabrication of High Conductivity Transparent Electrodes with Trenched Metal Bus Lines," *Journal of the Electro Chemical Society*, Vol. 138, No. 7, July, 1991. Their solution to this problem is TFEL display which utilizes augmented ITO electrodes in which the metal assist structure for each electrode is etched into the glass substrate. Each ITO electrode is then deposited over a metal conductor.

To make the panel disclosed by Gregory one must etch the glass substrate to provide paths for the metal assists and then the metal must be deposited in those grooves which have been cut into the glass. Etching the glass adds an additional step to the production. Additionally, making such grooves can cause the glass to crack or be more likely to fail in those areas. Therefore, this structure is not practical.

Thus, there is a need for an improved electroluminescent display panel which utilizes a metal assist structure, and which can be annealed without causing migration between the metal assist structure and a dielectric layer. Moreover, such an improved electroluminescent display must be easy to manufacture, preferably with conventional manufacturing techniques while adding no significant cost to the electroluminescent display.

SUMMARY OF THE INVENTION

A process for manufacturing a TFEL display allows for the deposition of metal assist structures in electrical and physical contact with corresponding transparent electrodes which can be annealed before the metal assist structure is placed. Hence, there is no migration problem during annealing. In the present method I provide a glass substrate and apply a layer of ITO electrode material thereon. This layer is etched to define out the individual ITO electrodes. Then, I apply a conventional stack of dielectric and phosphor layers to define a particular color response. The structure is annealed. The stack is then etched to define a cavity above a portion of each ITO electrode. A ITO assist structure is then deposited into each cavity over a portion of the metal electrode. Then the cavities are filled with a suitable insulator to define a planarization layer. The planarization layer can be formed of any suitable dielectric, but preferably is spun glass.

Other objects and advantages of the invention will become apparent from a description of the present preferred embodiments thereof.

DESCRIPTION OF THE PREFERRED EMBODIMENTS

Figure 1:
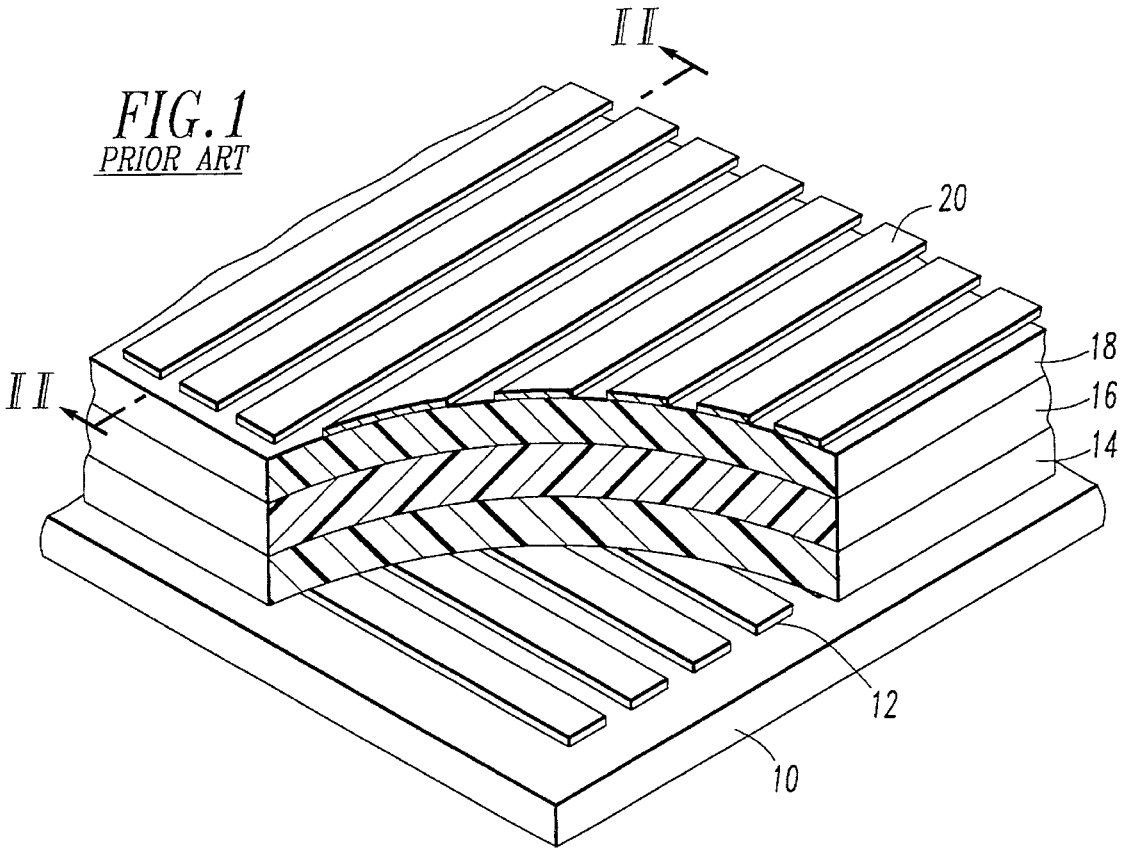
FIG. 1 PRIOR ART
FIG. 1 is a perspective view of the prior art electroluminescent display panel partially cut away.
Figure 2:
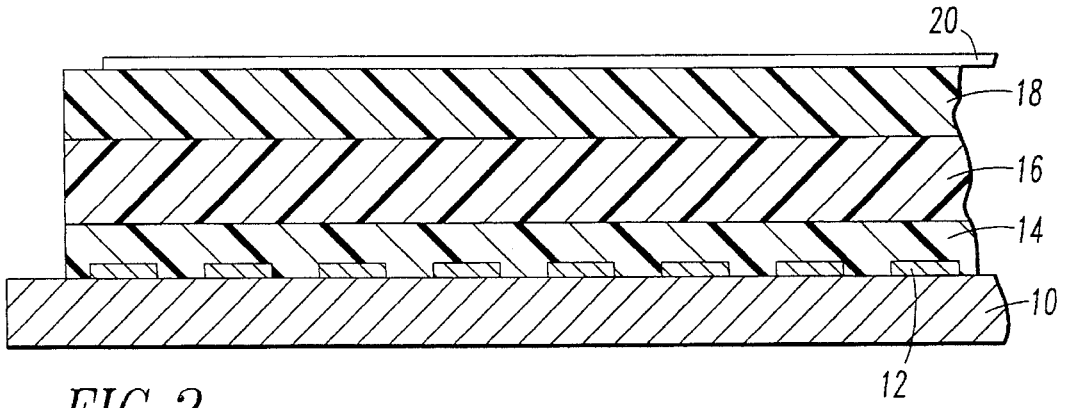
FIG. 2 PRIOR ART
FIG. 2 is a cross-sectional view of the prior art panel shown in FIG. 1.
Figure 3:
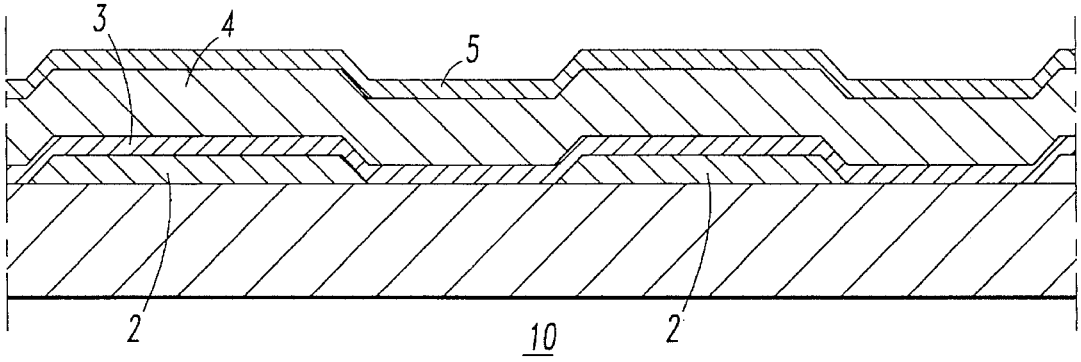
FIG. 3 is a cross-sectional view similar to FIG. 2 showing the electrode of the present invention after the ITO electrodes and the dielectric phosphor stacks have been applied.

Referring to FIG. 3 I provide a glass substrate 10 on which ITO electrodes 2 have been deposited. A dielectric layer 3, phosphor layer 4 and second dielectric layer 5 have been deposited over the ITO electrodes and glass substrates. The structure is annealed and then etched to create a cavity 9 over one end of each ITO electrode 2. Eching may be done by wet chemical etching, plasma etching or a combination thereof. The cavities then define a distinct stack 21, 22, 23 on each electrode. In the embodiment shown in the drawings the same phosphor is shown as being used in all stacks. Hence, this embodiment is a single color TFEL display. To form a multiple color display three differently doped phosphors are used to provide a repeating pattern of a red stack 21, a green stack 22 and a blue stack 23.

Figure 4:
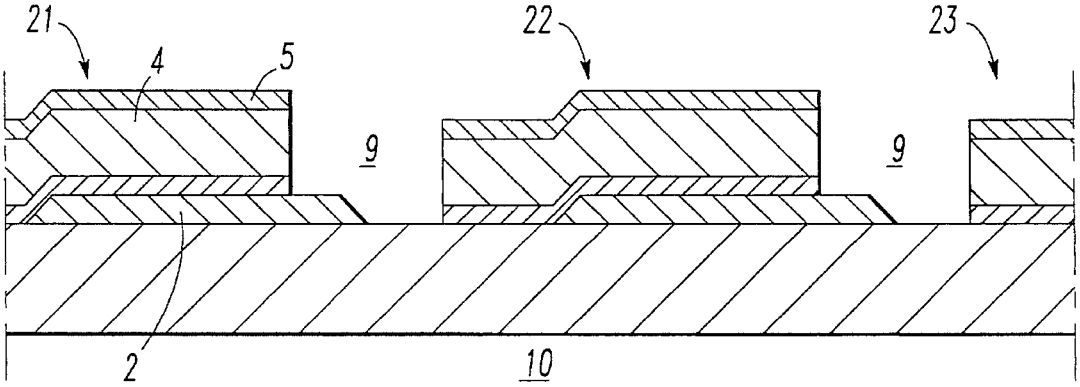
FIG. 4 is a cross-sectional view similar to FIG. 3 after cavities have been etched in the dielectric phosphor dielectric stack.
Figure 5:
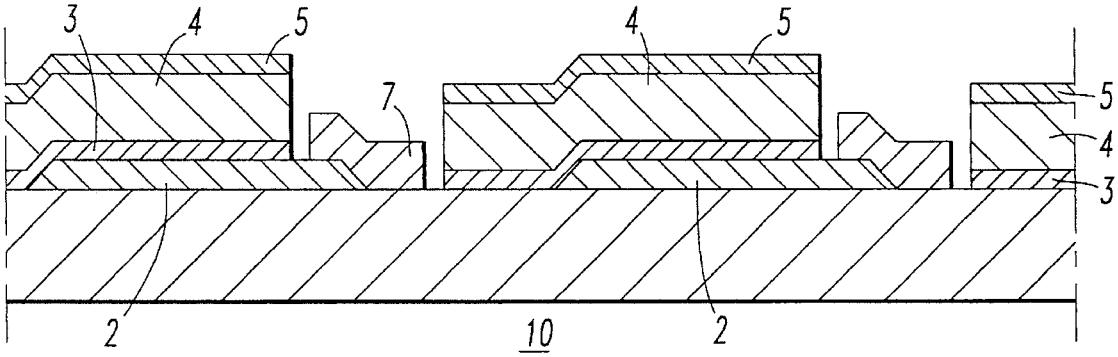
FIG. 5 is a cross-sectional view similar to FIG. 4 showing the structure after metal assist material has been deposited.

To create a multiple color display a layer of ITO material is deposited over the glass substrate. The ITO material is then etched to form ITO electrodes 2. Next a layer of dielectric material 3 is deposited over the ITO electrodes and glass substrate. The dielectric is then etched to form dielectric layers 3 as shown in FIG. 4. Next a red phosphor layer is deposited and etched to form distinct segments of red phosphor. Then a layer of green phosphor is deposited and etched to form the desired pattern of green phosphor segments. Finally, a blue phosphor material is deposited and etched to define the desired pattern of blue phosphor segments. After the phosphor layers have been deposited, a dielectric layer 5 is applied thereon. Then the panel is etched again to define the cavities 9 into which the metal assist structures will be deposited.

Figure 6:
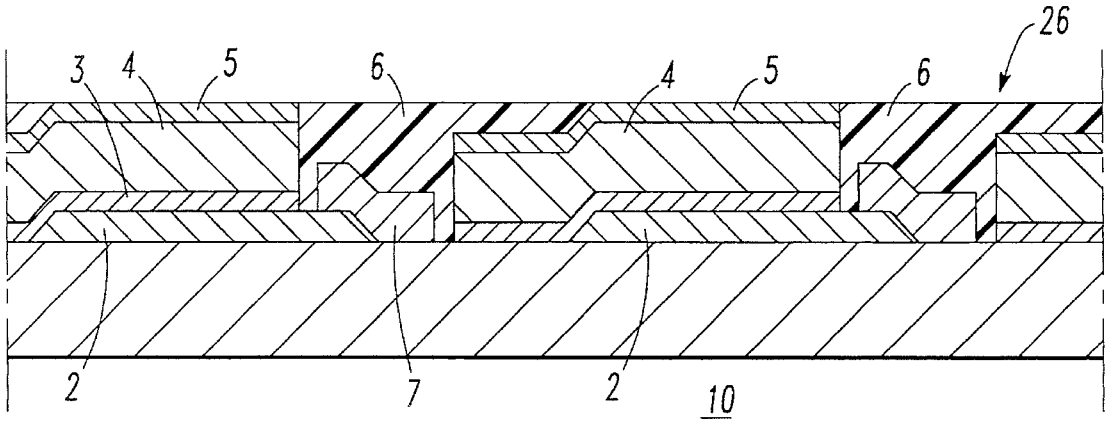
FIG. 6 is a cross-sectional view similar to FIG. 5 showing the structure after the planarization layer has been deposited.
Figure 7:
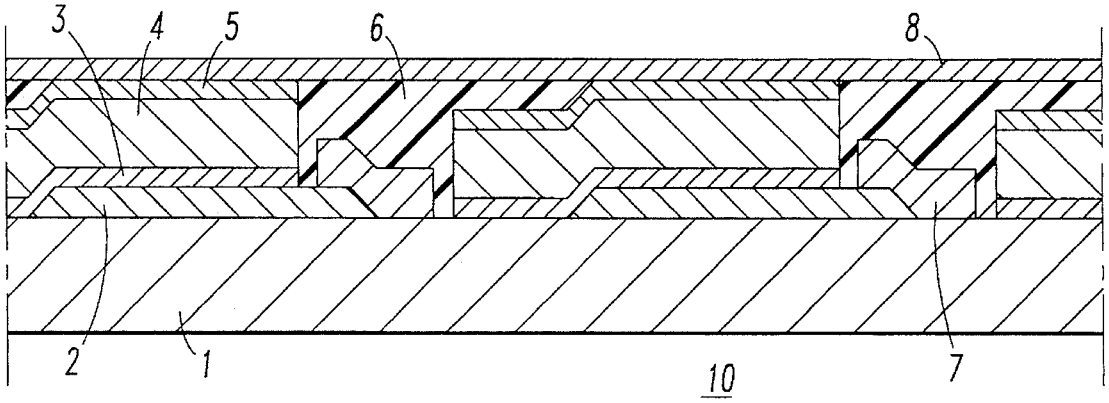
FIG. 7 is a cross-sectional view similar to FIG. 6 showing the structure after the top electrodes have been applied.

Whether the TFEL display is to contain a single phosphor color or three phosphor colors, the structure shown in FIG. 4 is created. The structure must be annealed before the metal assist structure is placed. I prefer that the annealing be done before the cavities 9 have been cut. However, the cavities could be cut before annealing the structure. After and annealed structure with cavities has been made, a metal assist structure 7 is deposited to extend over one edge of each ITO electrode and be within each cavity 9. Thereafter, a planarization material such as spun glass is placed over the electrode assist structure. The planarization layer 6 is deposited in the conventional way and etched or milled to define the preform structure 26 shown in FIG. 6. Finally, metal electrodes 8 are placed on top of the stacks to complete the electroluminescent display panel shown in FIG. 7.

This metal assist structure can be fabricated and the electrode resistance can be reduced from 10 ohms per square for the ITO alone or 1.5 ohms per square for other metal assist structure, to less than 0.5 ohms per square. The reason this structure can reduce electrode resistance so much more than earlier metal assist structures is that the present structure allows the use of low conductivity metals such as aluminum and further allows thicker metals to be used. The structure is annealed before the metal assist layer and planarization layers are applied. Thus, there is no problem with diffusion of oxygen or other contaminants into the metal during the annealing process. Such contaminants degrade the conductivity of the metals.

The TFEL display here disclosed maximizes the reduction in electrode resistance while minimizing the reduction in the light output area of the electrode. Additionally, the electrode can be made using conventional manufacturing practices while avoiding migration problems during annealing.

Although I have illustrated and described the present preferred embodiment and method, it should be distinctly understood that the invention is not limited thereto and may be variously embodied within the scope of the following claims.

I claim:

1. A method of fabricating an electroluminescent display panel comprising the steps of a) providing a substrate;

b) applying a layer of transparent ITO electrode material over the glass substrate;

c) etching the ITO layer to define a plurality of ITO electrodes;

d) applying a dielectric, phosphor and dielectric stack over the ITO electrodes;

e) etching the dielectric, phosphor and dielectric stack to a desired pattern such that there is a cavity above one edge of each ITO electrode to form a preform structure;

f) annealing the preform structure;

g) applying a metal assist structure over an exposed edge of each ITO electrode;

h) applying a planarization layer over the metal assist electrodes; and i) applying top electrodes over the dielectric phosphor and dielectric stacks.

2. The method of claim 1 wherein the planarization layer is one of a dielectric material of a same type as used in the dielectric, phosphor and dielectric stack and spun glass.

3. A method of creating an electroluminescent display structure comprising the steps of a) providing a substrate, b) applying an ITO electrode layer, c) etching the ITO layer to define a plurality of ITO electrodes, d) applying a red stack of dielectric red phosphor dielectric over a first set of selected ITO electrodes, e) etching the red stack to a desired pattern;

f) applying a green stack of dielectric green phosphor and dielectric over a second set of selected ITO electrodes;

g) etching the green stack to a desired pattern;

h) applying a blue stack of dielectric blue phosphor and dielectric over a third set of selected ITO electrodes;

i) etching the blue stack to a desired pattern;

j) annealing the glass substrate and stacks placed thereon;

k) etching the structure to form a cavity over one exposed edge of at least some ITO electrode;

l) applying a metal assist structure over the exposed edge of the at least some ITO electrodes;

m) applying a planarization layer over the metal assist structures; and n) applying top electrodes over the dielectric phosphor and dielectric stacks.

4. The method of claim 3 wherein the etching is performed by chemical etching.

5. The method of claim 3 wherein the etching is performed by plasma etching.

6. The method of claim 3 wherein the etching is performed by a combination of plasma etching and wet chemical etching.

* * * * *